US005597336A

United States Patent [19]

Evans

[11] Patent Number: 5,597,336

[45] Date of Patent: Jan. 28, 1997

[54] UNIQUE SWIM FIN

[76] Inventor: Robert B. Evans, 28 Anacapa St., Santa Barbara, Calif. 93101

[21] Appl. No.: 395,081

[22] Filed: Feb. 27, 1995

[51] Int. Cl.[6] ..... A63B 31/11

[52] U.S. Cl. ..... 441/64; 441/61

[58] Field of Search ..... 114/61–64

[56] References Cited

U.S. PATENT DOCUMENTS

| | | | |
|---|---|---|---|
| 2,343,468 | 3/1944 | Messinger | 9/21 |
| 3,178,738 | 4/1965 | La Trell | 9/309 |
| 3,810,269 | 5/1974 | Tabata | 9/309 |
| 4,121,312 | 10/1978 | Penney | 9/308 |
| 4,657,515 | 4/1987 | Ciccotelli | 441/64 |
| 4,664,639 | 5/1987 | Schneider | 441/61 |
| 4,832,644 | 5/1989 | Roberts | 441/64 |

FOREIGN PATENT DOCUMENTS

| | | | |
|---|---|---|---|
| 819804 | 5/1950 | Germany | 77/14 |
| 1039423 | 9/1958 | Germany | 441/64 |
| 2118608 | 4/1971 | Germany | 77/31 |
| 9415676 | 7/1994 | WIPO | 441/64 |

*Primary Examiner*—Sherman Basinger

[57] ABSTRACT

A uniquely configured fin (2) that has an open instep (60) and which is secured to the foot of the wearer by padded securement means (52) so as to accommodate a plurality of foot sizes and wherein the fin (2) is made in a two part single mold process. Protuberances (70) may be placed on selected drag surfaces of the fin (2) to act as vacuum breakers to reduce drag of the fin (2) as it propels a swimmer through the water.

16 Claims, 1 Drawing Sheet

UNIQUE SWIM FIN

FIELD OF THE INVENTION

This invention pertains to a unique swim fin which differs considerably from swim fins of the prior art in its basic concept of and in the configuration of the instep portion and in the fastening means for the instep portion and the heel portion in combination with formed, cushioned, fastening means for securement of the fin to the foot of a swimmer. Because of the overall uniqueness of the configuration of the open instep fin, a singular two part mold is capable of producing the fin as opposed to two separate molds in a two step process that have heretofore been necessary in production of those swim fins having a closed instep or foot portion of the swim fin. In addition, the swim fin of the invention has strategically placed knobby protuberances or knobs which are placed at selected surfaces so as to decrease the drag of the fin as it moves through the water.

BACKGROUND OF THE INVENTION

Swim fins of various types have been used for decades by scuba divers and other swimming enthusiasts in order to gain propulsion through the water medium. Swim fins have a variety of configurations and shapes with respect to forming a foot portion and heel portion of the fin for securement to the swimmer's foot. Where the closed, instep swim fin has been utilized, it has been necessary to have a dual mold operation in order to properly produce a closed instep swim fin. That is one mold is used to mold the softer, more conformable closed foot portion and a separate mold is used to mold the more sturdy fin portion. The two independently molded pieces are then secured together.

As indicated, traditionally, the closed instep portion has been molded separate from the main fin portion with subsequent securement together to form the completed swim fin. In the prior art dual mold process, it has been necessary to have a plurality of swim fins that would accommodate various sizes of the swimmer's feet. In those instances where an open instep configuration has been utilized, they have been of the shoelace type, not having cushioned fastening for either the instep portion of the swim fin or the heel portion, and in those instances where the laced instep design has been resorted to, the fin has been singularly molded, as far as can be determined, wherein the back strap or heel portion is of the non-adjustable type.

In swim fins of the prior art, it has been necessary to have a plurality of sizes in order to accommodate various sized feet, thereby adding to the inventory cost of the fins manufacturer.

Also, in prior art fins, the closed foot portion, being of less sturdy material to provide conformability to the foot of the user has deteriorated more rapidly, over time, than the remainder of the fin, requiring that the fin be disregarded when the less sturdy or closed foot portion failed. This problem is overcome with the instant invention in that the single or integral fin is of sturdy material and the softer, conformable members of the securement means are easily replacable when, over time, they deteriorate, thereby extending the overall life of the fin.

Fins also have been proposed which have not been adequately responsive to fluid dynamic demands of a swimming fin being used in dynamic fashion in moving a swimmer through the water medium. The swim fins of some prior art patents have suggested putting cleats or knobs on heel portions of the swim fin where the user uses the fins as a steadying device, as for example, where a user fisherman is supported by an inner tube and wears the fins for propulsion purposes and the cleats or knobs are for gripping river bottoms and the like in a more efficient manner.

None of the prior art fins, as far as is known, has strategically placed protuberances projecting in a manner to create surface tension breakers to thereby create vortices to reduce the drag of the fin moving through the water. These protuberances eliminate the vacuum that slows water flowing off typical drag surfaces of a swim fin, thereby increasing propulsion.

As exemplary of some of the prior art, the following patents were uncovered in preliminary patent searches in the United States Patent Office:

| U.S. Pat. No. | Inventor | Issue Date |
|---|---|---|
| 1,007,867 | E. G. Halvorsen | Nov. 7, 1911 |
| 2,343,468 | H. L. Messinger | Mar. 7, 1944 |
| 3,239,857 | F. H. Gwynne | Mar. 15, 1966 |
| 4,251,894 | Ashley J. Hollingsworth | Feb. 24, 1981 |
| 4,664,639 | John D. Schneider | May 12, 1987 |
| 4,832,644 | Elizabeth B. Roberts | May 23, 1989 |
| 4,857,024 | Robert B. Evans | Aug. 15, 1989 |

A more in-depth description of each of the more pertinent patents follows:

U.S. Pat. No. 1,007,867

This patent is directed to, what may be considered, the seminal swimming device, wherein a sandal-like member is formed and to the bottom of which is attached the blade member 17, wherein adjustable straps, such as 14 and 11, using a conventional buckle is used for securing the swimming device to the foot of the swimmer.

U.S. Pat. No. 2,343,468

This patent is directed to a propulsion device for swimmers which shows the open instep portion 14 having laces for securement of the propulsion device and main body 10 around the ankle of the swimmer. The heel strap 13, which is not adjustable nor cushioned, attaches the main body 10 of the propulsion device to the heel of the swimmer.

U.S. Pat. No. 3,239,857

This patent is directed to a swim fin having, what might be termed, an open instep forming a socket 12 for containing the forepart of the foot of a swimmer. The socket member 12 is connected to a leg-encasing member 20 and a snap button, such as 23, is utilized to attach the leg-encasing portion 20 to the swimmer.

U.S. Pat. 4,251,894

This patent is directed to a swim fin, wherein the heel portion has a self-adjusting strap wherein the fin has a closed foot pocket 10.

U.S. Pat. No. 4,664,639

This patent is directed to a foot fin utilized by a fisherman or the like and has secured to the foot fin a plurality of spaced cleats 15 to aid the fisherman walking on a surface of a river bottom or the like.

U.S. Pat. No. 4,832,644

This patent is directed to a swimming fin which has an adjustable heel strap 20 which is provided with a heel protection device comprising a heel protector 14 of polymer foam material so that chafing of the heel of the swimmer does not occur or is substantially reduced.

U.S. Pat. No. 4,857,024

This patent relates to the ubiquitous type of swim fin having movable tips with an adjustable heel strap 62 which may utilize fastening means 64 which may also be a velcro fastener.

SUMMARY AND OBJECTS OF THE INVENTION

It is an object of the invention to provide a uniquely configured swim fin which has an open instep and cushioned securement means for securement to the foot of the user of the fin.

It is another object of the invention to provide a swim fin having an open instep with an adjustable instep strap which is cushioned to accommodate various sized feet of the swimmer.

It is still another object of the invention to provide a swim fin having an open instep which is capable of accommodating a myriad of foot sizes and which is capable of being produced in a single mold process.

It is another important object of the invention to provide a swim fin having an open instep and open heel configuration wherein cushioned, adjustable means are utilized to secure the instep portion and the heel portion of the fin to the foot of the user thereof.

It is another important object of the invention to provide a swim fin that is capable of being produced in a single mold process to produce an integrally molded fin.

It is another object of the invention to provide an integrally molded fin having a plurality of knobby protuberances strategically placed on selected drag surfaces so as to reduce the drag of said fin to water when the fin is in use.

It is another important object of the invention to provide a swim fin with spaced protuberances strategically placed on drag surfaces of a swim fin to create vortices to thereby reduce the drag on the fin as it moves through the water during use.

These and other objects of the invention are accomplished by the unique configured swim fin having an open instep and having adjustable and cushioned securement means for securing the fin to the foot of the user and wherein the fin is provided with strategically placed protuberances to thereby reduce the drag of the fin as it moves through the water during use.

Generally, the swim fin comprises a portion having an open instep and a planar heel portion adapted to receive the human foot, wherein the fin has upstanding, projecting ear portions forming a receiving channel for the foot of the user and wherein cushioned, fastening means are secured to the upstanding ear portions and the heel portion of the fin for securing the fin to the human foot.

Additionally, there is disclosed a swim fin being provided with a plurality of knobby protuberances on one or more surfaces of the fin, within the area of normal drag resistance of said fin as it moves through the water, to thereby decrease the drag of the fin through the water during use thereof.

These and other objects of the invention will become apparent from the hereinafter following commentary taken in conjunction with the drawings.

DETAILED DESCRIPTION OF PREFERRED EMBODIMENTS OF THE INVENTION

Figures 1, 2, 3, 4, 5, 6:
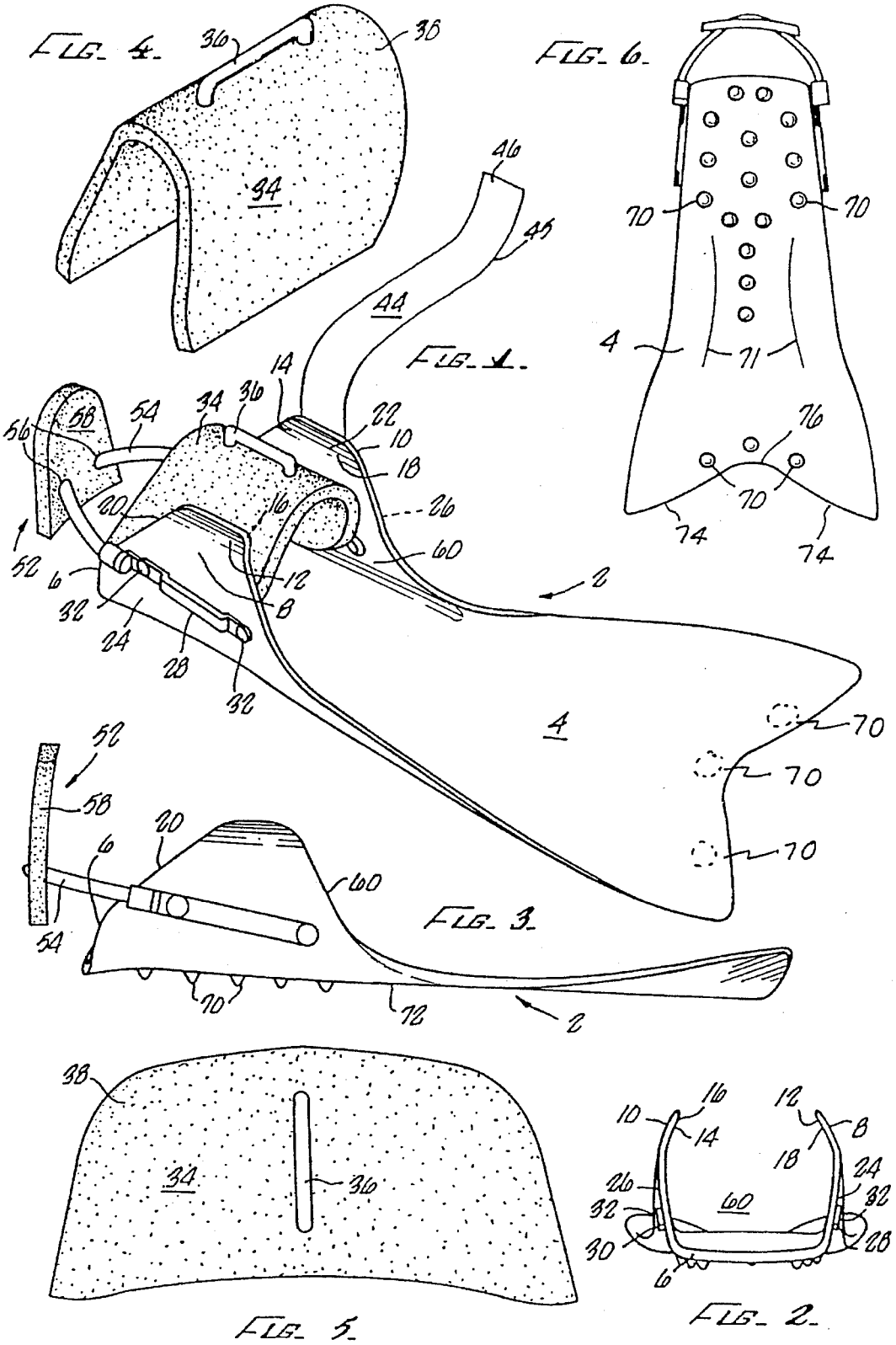
FIG. 1 is a perspective view of one embodiment of the invention, illustrating the single mold configuration of a swim fin, with an open instep and adjustable and cushioned fastening means.
FIG. 2 is a rear view of the upstanding ear portions of the fin of the invention without the securement straps being shown for purposes of clarity.
FIG. 3 is a side view of one of the fins of the invention showing strategically placed protuberances on at least one surface of the fin wherein drag resistance of the fin is encountered during use.
FIG. 4 is an enlarged view of the cushioning, instep portion of the swim fin of the invention.
FIG. 5 is a view of the cushioned portion of FIG. 4 being shown in the laid out position.
FIG. 6 is a bottom view of a swim fin in accordance with the embodiments of the invention showing strategically placed protuberances for reducing drag of the swim fin through the water during use.

Referring to the figures of drawings wherein like numerals of reference designate like elements throughout, it will be seen that the swim fin 2 of the invention has forwardly extending fin portion 4 with a fluke-like configuration and wherein the rearward portion has a planar heel portion 6 having upwardly extending ear portions 8 and 10 wherein the termini 12 and 14 are inwardly extending. It will be noted that the interior surfaces 16 and 18 of termini 12 and 14 are tapered so as to form a better fit to the instep of the foot of the user (not shown) of swim fin 2.

It will be noted that upstanding ear portions 8 and 10 have a truncated or forwardly tapered portion 20 and 22 extending toward the fluke or fin portion 4 of swim fin 2.

Secured to base portions 24 and 26 of ear portions 8 and 10, are brackets 28 and 30, secured to lower portions 24 and 26 of upstanding ear portions 8 and 10 by means of through rivets 32.

Brackets 28 and 30 perform the dual purpose of anchoring heel and instep fastening means, as will be described.

Adapted to be secured over the instep of the foot of the user is instep cushion 34 of latex foam or the like cushioning material of about ⅛" to ¼" thickness and configured to closely approximate the shape or instep portion of the foot of the user as depicted in FIG. 5 and wherein the instep cushion 34 is provided with a conformable material loop 36 secured to the upper surface 38 in the mid point thereof as shown in FIGS. 1, 4 and 5.

Secured to bracket member 28 is an elongated strap 44 having end 46 adapted to pass over the upper surface 38 of instep cushion 34 and underside of loop 36 secured to instep cushion 34 to thereby hold instep cushion 34 in snug relationship to the instep of the foot of the user. The terminus 46 of strap 44, after passing through the loop 36, is secured under bracket 30 in the conventional manner, and securement is accomplished by velcro strips (not shown) on upper surface 45 of terminus 46 of belt 44.

Referring to FIGS. 1 and 3, the rear or heel cushion fastening means 52 is illustrated. In this particular instance, the fastening means 52 takes the form of elastic loop 54, secured to the ends of brackets 28 and 30 wherein the elastic 54 is of the conventional, strong and sturdy type with a low modulus of elasticity and which is looped through apertures 56 in cushion member 58 of cushion foam or latex material of the same thickness and construction as instep cushion 34. The heel fastening means 52 provides the means whereby the fin 2 is adequately associated with the heel of the user of the fin.

In use, the instep cushion member 34 being secured to strap 44 is in its initial, non-foot conforming position so as to form an open channel 60 into which the foot of the user is placed with the heel of the foot of the user being rearwardly positioned in snug surface contact with heel pad 58, comprising heel fastening means 52. Thereafter, strap 44 with the engaged instep cushion member 34, is brought into super position to the instep of the foot of the user and the terminus 46 and strap 44 is secured by means of bracket 30 in snug, tight fitting relationship to the foot of the user through use of the velcro strips.

Thus, the fin 2 is secured to both the heel portion and the instep portion of the foot of the swimmer utilizing the swim fin 2. It is understood, of course, that two such fins 2 are generally used by the swimmer.

It will be seen that in the specific embodiment depicted, that the swim fin 2 has a plurality of spaced, knobby (or knob-like) protuberances 70 placed on the under surface 72 of fin 2. In this particular instance, referring to FIGS. 3 and 6, the conically shaped protuberances 70, about ⅛ to ½ inch in height, with a lower most diameter of about ½ inch are molded integrally with the fin 2 and are of the same material of construction. The protuberances 70 may be placed in the conventional and known in the art drag surfaces of the fin. In this particular instance, protuberances 70 are placed in the lateral drag edges 74 adjacent the under surface of the foot of the user of swim fin 2 and also at the intersecting point or portion 76 of flukes 4 of fin 2.

The number and specific placement of the protuberances 70 will make themselves readily apparent to those of ordinary skill in the art, depending upon the overall configuration of the fin with which the protuberances 70 are associated.

That is, with regard to the specific fin configuration shown in the drawings, the protuberances 70 are placed in those drag locations known to produce drag of the specific fin through the water medium with which the fin is used. The protuberances or knobbs 70 create vortices to reduce the drag of the fin 2 moving through the water.

As shown in FIG. 6, the protuberances 70 work as surface tension breakers and when properly placed, either laterally of the fin or adjacent to the line of intersection of the fluke ends 4 of fin 2 as shown, will eliminate the vacuum that slows water flowing off the fin 2, thereby increasing overall propulsion of the fin 2 when used by the swimmer in a water medium. It will be noted that spaced longitudinal stiffening beads 71 are incorporated in the undersurface of fin 2 for purposes well known in the art. As shown in FIG. 6, the stiffening beads or ribs 71 are positioned approximately midway between the central longitudinal axis of fin 2 and its side edges.

Other fin surfaces and configurations will dictate placement of protuberances 70 at-various locations such as along the central longitudinal axis of the fin between beads 71 (see FIG. 6), or in the heel portion of the fin (see FIG. 6), and those of ordinary skill in the art need only determine where the specific drag surfaces are and then provide protuberances in a spaced manner along those drag surfaces. For example, in the fin configuration as shown in FIG. 1, the protuberances may be placed as shown in dotted lines on the upper surface of fin 2. Thus, the protuberances 70 may be placed in either or both of the upper and bottom surfaces of fin 2, in locations where drag is known to exist.

The cushioned members 34 and 58 of the fastening means for the fin 2, may be of various materials, but generally are of the foam latex type, acting to perform not only cushioning but also contributing to flotation, which aids the swimmer in use of the fins 2.

Thus, there has been disclosed a unique configured swim fin that is integrally molded of polyurethane material, for example, with or without drag decreasing protuberances, wherein a foot pocket or channel is provided to accommodate a wide variety of sized feet in a facile manner.

The swim fin of the disclosed invention provides pads of molded and soft spongy material, such as neoprene or other extruded or molded foam, which soft spongy inserts act in a manner to prevent abrasion of selected portions of the foot of a user, such as the instep, ankle and sides of the instep and ankle. The tightening down or rigid securement of straps or elastic bands in order to rigidly hold the fin to the foot of the person is cushioned by reason of the cushioned inserts or members, such as 34 and 58. The unique configuration of the fin allows for the fabrication thereof in a single molding process to accommodate a myriad of foot sizes.

Various modifications may be made to the disclosed fin invention, as for example, by varying the manner of securing the cushion pads to the securement straps or elastomeric members or using different brackets secured to the instep portions of the fin. All such changes and modifications will make themselves known to those of ordinary skill in the art, and all such modifications are intended to be covered by the appended claims.

I claim:

1. A swim fin comprising the combination of:

a foot portion having an open instep and an open, planar heel portion adapted to receive the human foot, said fin having upstanding, projecting ear portions adjacent and coterminous with said open, planar heel portion and forming a receiving channel for the foot of the user of said fin and cushioned, fastening means secured to said upstanding ear portions and said heel portion for securing said fin to the human foot, said cushioned, fastening means including a substantially planar contoured cushion member conformable to a rear portion of said human foot, said cushion member having a pair of displaced openings formed therethrough and an elastic loop member having opposing ends secured to respective ones of said ear portions, said elastic loop member passing through said openings formed through said cushion member.

2. The swim fin in accordance with claim 1, including an instep cushion member positioned contiguous the instep portion of said human foot and a strap cooperatively intertwined with and captured by said instep cushion member.

3. The swim fin in accordance with claim 1, wherein said upstanding ear portions have tapered inner surfaces.

4. The swim fin in accordance with claim 1, wherein said swim fin is integrally molded.

5. The swim fin in accordance with claim 1, wherein spaced, knobby protuberances are placed on at least one surface of said fin in order to reduce the drag characteristics thereof.

6. The swim fin in accordance with claim 5 wherein said protuberances are located on the upper surface of said fin on opposed lateral surfaces thereof.

7. The swim fin in accordance with claim 6 wherein the underside of said fin also has protuberances located in the heel portion of said fin.

8. The swim fin in accordance with claim 7 wherein the underside of said fin is ribbed.

9. The swim fin in accordance with claim 8 wherein said protuberances are knob-like in configuration.

10. In a swimming fin the improvement comprising:

individual, spaced, and knobby protuberances molded in integral manner to at least one surface of said fin within the area of normal drag resistance of said fin as said fin moves through the water, said protuberances for creating vortices to reduce the drag of the swimming fin as said swimming fin moves through the water.

11. The swim fin in accordance with claim 10 wherein said protuberances are located on the underside of said fin and are spaced at the extreme edge of said fin opposite the heel portion thereof.

12. The swim fin in accordance with claim 10 wherein said spaced protuberances are located on the underside of said fin in the central portion thereof along the central longitudinal axis of said fin.

13. The swim fin in accordance with claim 12 wherein there are two spaced beads, spaced in offset from the central longitudinal axis of said fin, said beads being formed throughout the length of said beads in one piece formation with said fin.

14. The swim fin in accordance with claim 13 wherein said protuberances are conically shaped.

15. In a swimming fin the improvement comprising:

spaced, conically shaped protuberances molded to at least one surface of said fin within the area of normal drag resistance of said fin as said fin moves through the water, said spaced protuberances located on the underside of said fin in the central portion thereof along a central longitudinal axis of said fin; and two spaced molded beads extending in a direction coincident with said longitudinal axis and spaced in offset relation from the central longitudinal axis of said fin.

16. The swim fin in accordance with claim 15 wherein spaced, conically shaped protuberances are also located on the underside of said fin and are spaced at the extreme edge of said fin opposite the heel portion thereof.

* * * * *